US005675894A

United States Patent [19]

Lin

[11] Patent Number: 5,675,894

[45] Date of Patent: Oct. 14, 1997

[54] MECHANICALLY OPERATED RAZOR

[76] Inventor: Hung Lung Lin, 1Fl., No. 16, Lane 45, Kuang Fu S. Rd., Taipei City, Taiwan

[21] Appl. No.: 717,891

[22] Filed: Sep. 23, 1996

[51] Int. Cl.[6] ..... B26B 19/14

[52] U.S. Cl. ..... 30/43.6

[58] Field of Search ..... 30/43.4, 43.5, 30/43.6

[56] References Cited

U.S. PATENT DOCUMENTS

| | | | |
|---|---|---|---|
| 2,808,645 | 10/1957 | Tournier | 30/43.6 |
| 2,851,772 | 9/1958 | Monnet | 30/43.6 |
| 3,141,240 | 7/1964 | Gwinn | 30/43.6 |
| 4,275,496 | 6/1981 | Gotoh | 30/43.6 |
| 5,014,428 | 5/1991 | Yamashita | 30/43.6 |
| 5,341,570 | 8/1994 | Kumakawa | 30/43.6 |

FOREIGN PATENT DOCUMENTS

| | | | |
|---|---|---|---|
| 1108557 | 1/1956 | France | 30/43.6 |
| 53-133151 | 11/1978 | Japan | 30/43.6 |

*Primary Examiner*—Hwei-Siu Payer

*Attorney, Agent, or Firm*—Beveridge, DeGrandi, Weilacher & Young LLP

[57] ABSTRACT

Disclosed is a mechanically operated razor which does not require any electric power supply while functioning as a power-driven shaver. The razor mainly includes a housing, a driving mechanism, a transmission mechanism, a top cover, a shaving blade, and a mirror. Repeatedly pushing a push button of the driving mechanism toward the housing causes a rack connected the push button to move inward and to mesh with and rotate a gear of the transmission mechanism. The rotating gear in turn brings other gears of the transmission mechanism and a flywheel to rotate, causing the shaving blade to rotate rapidly for a prolonged time. The rotating flywheel may reduce the times the push button is depressed while prolongs the rotating of the shaving blade, so that the razor functions like an electrically driven razor. A cleaning brush is removably attached to the razor for cleaning the razor after shaving. A cotter coupled with a switch button on the push button can be ascended to engage with the top cover when the push button is fully pushed into the housing and the switch button is pushed upward, and thereby retains the entire push button in the housing, allowing the razor to be conveniently stored or carried.

3 Claims, 3 Drawing Sheets

MECHANICALLY OPERATED RAZOR

BACKGROUND OF THE INVENTION

1. Field of the invention

The present invention relates to a mechanically operated razor, and more particularly to a razor which does not require power to drive it and can be easily assembled. The razor is small in volume for easy storage and has parts that are not easily worn off and can therefore have longer usable life.

2. Description of the Prior Art

The power consumption in our daily life largely increases with the highly developed technology and the widely established electric power stations. Most of the commercially available products or newly introduced products are power-driven items. Most people do not remember the difficult days without or with limited power supply. It is apparent that people have no idea of a power supply crisis.

It is therefore desirable to develop products which do not require power to drive them but have the same functions as those power-operated products. A mechanically operated razor is therefore developed by the inventor.

SUMMARY OF THE INVENTION

A primary object of the present invention is to provide a mechanically operated razor which does not require power to drive it and can be easily operated with fingers. The razor according to the present invention uses a rack connected to a push button to drive a series of gears and thereby rotates a shaving blade seat. A flywheel is used to prolong the rotation of the shaving blade seat and to reduce the times of pushing button required to drive the razor. Whereby the razor of the present invention is functionally equivalent to an electric shaver while it does not require power at all.

Another object of the present invention is to provide a mechanically operated razor which is provided at a bottom of its housing with a mirror, and at an inner side of its push button with a cleaning brush, so that the user may look in the mirror while shaving and use the brush to wipe off the cut hairs from the razor after shaving.

A further object of the present invention is to provide a mechanically operated razor which is provided at a front surface of its push button with a switch button to control the ascending or descending of a cotter on the push button. The ascended cotter engages with a receiving hole provided on a top cover of the razor and thereby holds the inward pushed push button in the housing of the razor for convenient storage or carrying.

BRIEF DESCRIPTION OF THE DRAWINGS

The detailed structure and the functions of the present invention can be best understood from the following detailed description of the preferred embodiment and the accompanying drawings, wherein.

DETAILED DESCRIPTION OF THE PREFERRED EMBODIMENT

Figure 1:
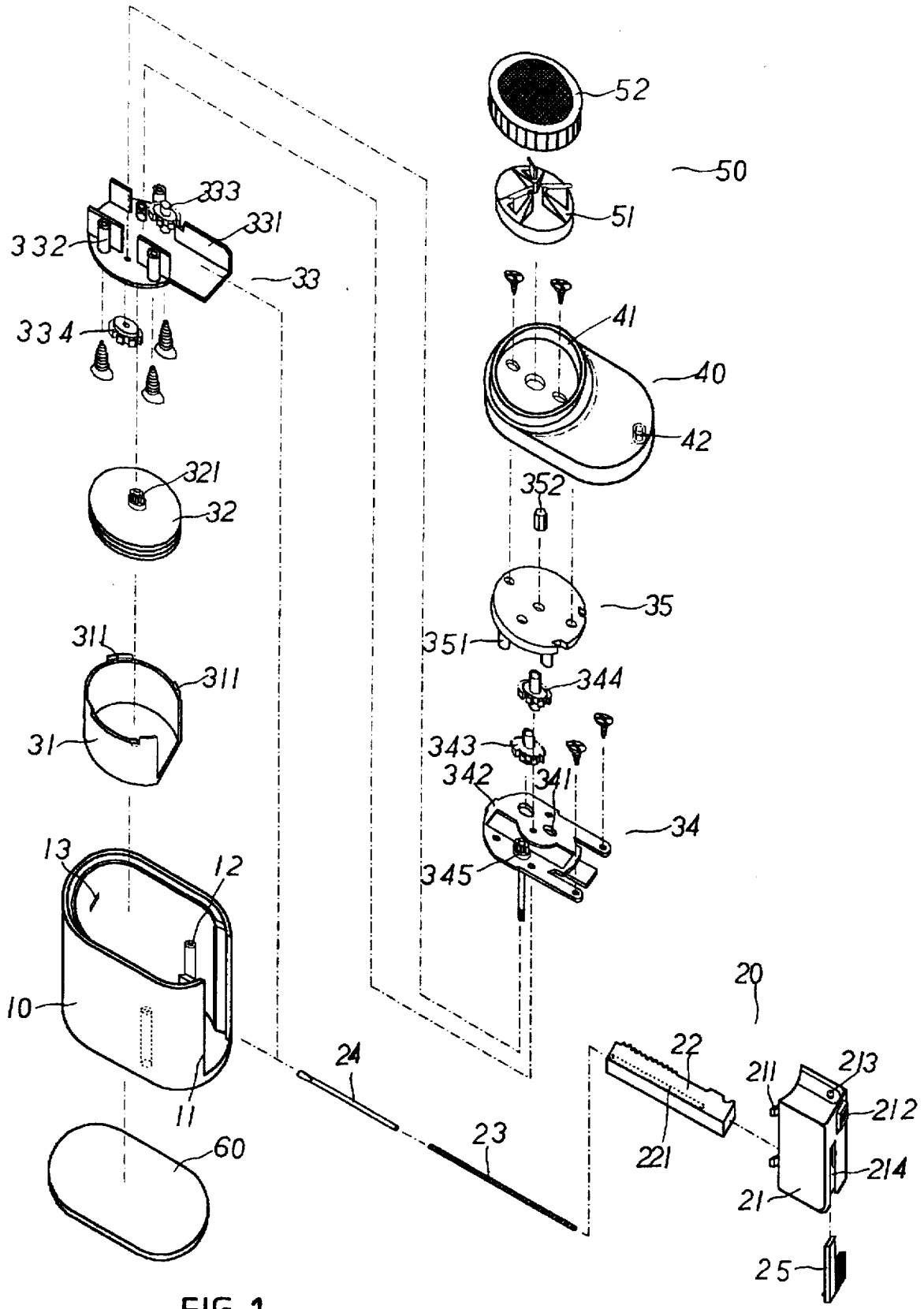
FIG. 1 is an exploded perspective of the present invention.
Figure 2:
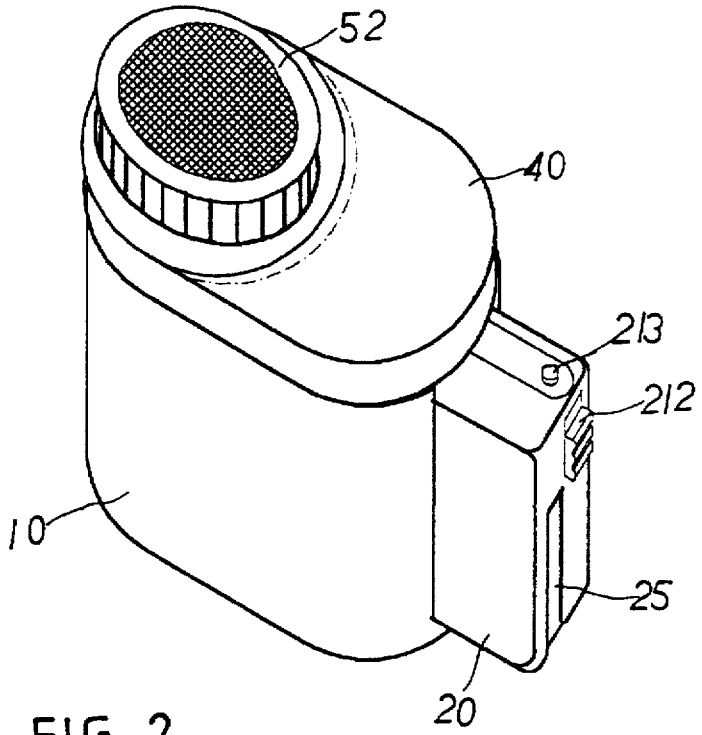
FIG. 2 is an assembled perspective of the present invention.

Please refer to FIGS. 1 and 2. The present invention relates to a mechanically operated razor which can be easily driven to operate only by fingers. The razor of the present invention mainly includes a housing 10, a driving means 20, a transmission means, a top cover 40, a shaving blade means 50, and a mirror 60.

The housing 10 is provided at a distant end with an opening 11 to receive the driving means 20 therein so that the driving means 20 can be moved inward or outward within a path defined by the opening 11. Two locating members 12 with predetermined height are separately fixed to two side walls of the housing 10 near the opening 11. Screws may be screwed into the locating members 12. A dent 13 is formed on an inner surface of the housing 10 opposite to the opening 11. A recess is formed at an outer bottom surface of the housing 10 for removably receiving the mirror 60 therein.

The driving means 20 mainly includes a push button 21, a rack 22, a spring 23, and a push pin 24. Projections 211 are provided at a rear surface of the push button 21 and laterally project therefrom to abut against two vertical inner edges of the opening 11 of the housing 10 when the push button 21 is in an extended position. A switch button 212 is provided to a front surface of the push button 21 near a top end thereof. The switch button 212 is coupled with a cotter 213 retractably projected from a top surface of the push button 21. When the push button 21 is pushed into the housing 10 and the switch button 212 is pushed upward, the cotter 213 is brought to move upward, too, and is retained in a receiving hole 42 formed on the top cover 40. When the cotter 213 is retained in the receiving hole 42, the push button 21 can be retained within the housing 10 with its front surface flush with the opening 11 of the housing 10. A flat compartment 214 is provided behind the front surface of the push button 21 below the switch button 212 for a cleaning brush 25 to removably set therein. The brush 25 has a boss which detachably engages with a dent (not shown) formed on a wall of the compartment 214, permitting the brush 25 to attach to the compartment 214 without easily falling therefrom. The rack 22 is connected at one outer end to a retaining means (not shown) inside the push button 21 by means of tight fit. The other end of the rack 22 is inserted into the transmission means the detail of which will be described later. Teeth of the rack 22 are located at one lateral side surface of the rack 22. An axially extended long hole 221 is centered in the rack 22 for receiving the spring 23 and the push pin 24 therein.

The transmission means is mounted inside the housing 10 mainly includes a base 31, a flywheel 32, a first deck 33, a second deck 34, and a third deck 35. The base 31 includes a bottom and a thin wall surrounding and vertically projecting from the bottom, defining a space therein with an upward opening. Four lugs 311 laterally project from a top edge of the thin wall of the base 31 to engage with an outer periphery of the first deck 33. The flywheel 32 is disposed in the base 31 and has a first gear 321 located and centered at a top surface thereof. The first deck 33 is disposed above the base 31 and the flywheel 32 and includes a channel 331 for receiving another end of the rack 22 therein and three internally threaded sleeves 332 provided on a top surface of the first deck 33 outside the receiving channel 331 at predetermined positions. A second gear 333 is provided beside the channel 331 so that it meshes with the teeth of the rack 22. A third gear 334 is disposed below the first deck 33 to engage with the first gear 321 on the flywheel 32. The second deck 34 is located over the first deck 33. The second deck 34 has an oblong shaft hole 341 formed thereon corresponding to the second gear 333 on the first deck 33 to receive an upper shaft of the second gear 333 therein, a rearward projected lug 342 engaging with the dent 13 formed on the housing 10 at a rear side thereof, a fourth gear 343 driven by the second gear 333 through a pinion connected to a lower shaft of the fourth gear 343 below the second deck 34, a fifth gear 344 located at a center of the second deck 34, and a sixth gear 345 located at one side of the second deck 34 and having a shaft downward extended through the second deck 34 and the first deck 33 to insert through and connect the third gear 334 below the first deck 33.

When the push button 21 is pushed inward, the side teeth of the rack 22 mesh with the second gear 333 to transmit force from the push button 21 to the second gear 333. And, when the push button 21 is pushed outward by the spring 23, the outward spring force shall also pull the second gear 333 outward for a certain distance, causing the upper shaft of the second gear 333 to bias in the oblong shaft hole 341. The biased second gear 333 disengages from the pinion below the fourth gear 343, allowing the flywheel 32 to keep rotating due to an inertia. This rotating force is transmitted to the shaving blade means 50 via the gears and drives the shaving blade means 50 to rotate.

The third deck 35 is located over the second deck 34 and is provided at a bottom surface with three internally threaded sleeves 351 corresponding to the internally threaded sleeves 332 of the first deck 33. The fifth gear 344 has an upper shaft upward extending through the third deck 35 to engage with a cap 352.

The top cover 40 has a profile corresponding to that of the housing 10. A shallow recess serving as a receiving seat 41 is formed on a top surface of the top cover 40 at a position corresponding to the third deck 35. Threads are provided to an outer periphery of the receiving seat 41. A receiving hole 42 is formed on a lower surface of the top cover 40 at a position corresponding to the opening 11 of the housing to receive the upward extended cotter 213 of the push button 21 of the driving means 20.

The shaving blade means 50 has a profile corresponding to that of the receiving seat 41 of the top cover 40 and mainly includes a shaving blade seat 51 and a sieve-like blade cover 52 having a plurality of through holes thereon. The shaving blade seat 51 is positioned in the receiving seat 41 and the blade cover 52 is screwed to the threaded outer periphery of the receiving seat 41. The cap 352 on the third deck 35 extends upward to engage with a bottom center of the shaving blade seat 51. Whereby a push force transmitted from the push button 21 via the rack 22, the series of gears and the flywheel 32 is transformed to a turning force which is finally transmitted to the cap 352 to drive the shaving blade seat 51 engaged with the cap 352 to rotate.

Figure 3:
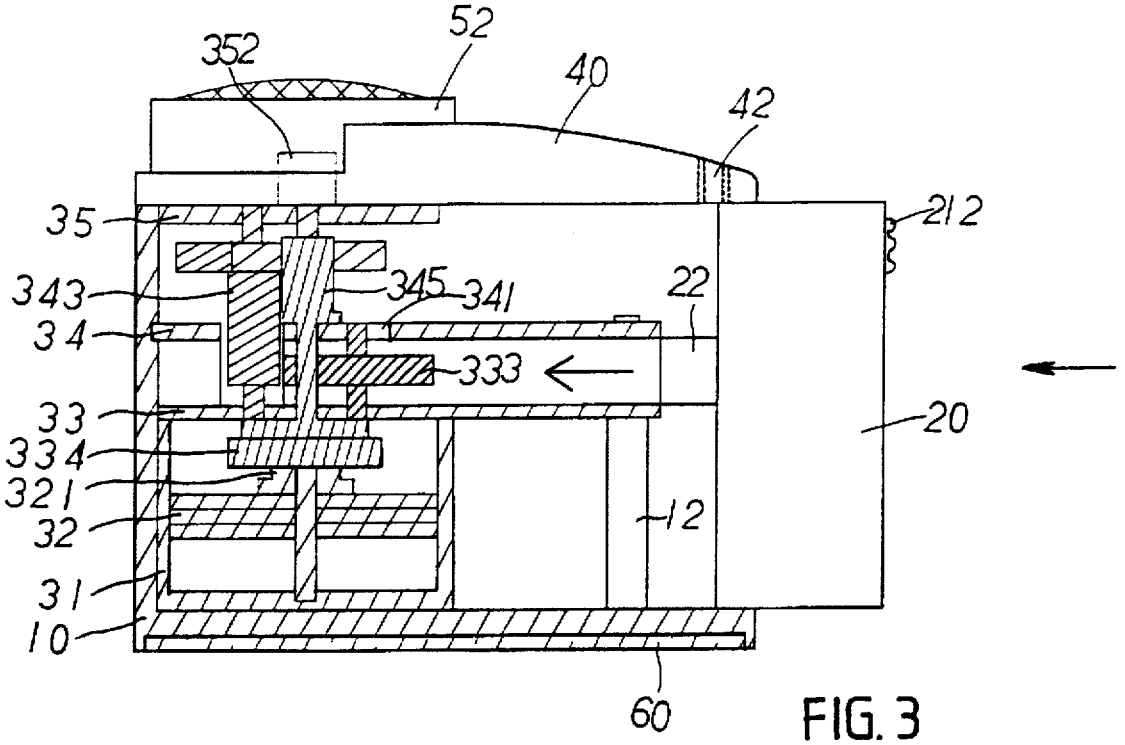
FIGS. 3 and 4 are side sectional views showing the manner in which the present invention is operated.

Please refer to FIG. 3. It is very easy to operate the razor of the present invention after it is assembled. First, repeatedly push the push button 21 of the driving means 20, causing the teeth of the rack 22 connected at one end to the push button 21 to mesh with and thereby rotate the second gear 333 mounted on the first deck 33. The rotating kinetic energy of the second gear 333 is then sequentially transmitted to the fourth and the fifth gears 343, 344 mounted on the second deck 34. At this point, the cap 352 located above the third deck 35 and engaged onto the shaft of the fifth gear 344 is driven by the fifth gear 344 to rotate and causes the shaving blade seat 51 attached to the cap 352 to rotate at the same time. Since the fifth gear 344 meshes with the sixth gear 345, the rotating kinetic energy of the fifth gear 344 is transmitted to the sixth gear 345. The third gear 334 below the first deck 33 is mounted around the downward extended long shaft of the sixth gear 345 and therefore rotates along with the sixth gear 345 in the same direction. Since the third gear 334 meshes with the first gear 321 on the flywheel 32, the rotating kinetic energy is further transmitted to the flywheel 32. The flywheel 32 keeps rotating due to an inertia and therefore prolongs the turning of the shaving blade seat 51 while reduces the times of depressing the push button 21 required to drive the rack 22 and the series of gears.

Figure 4:
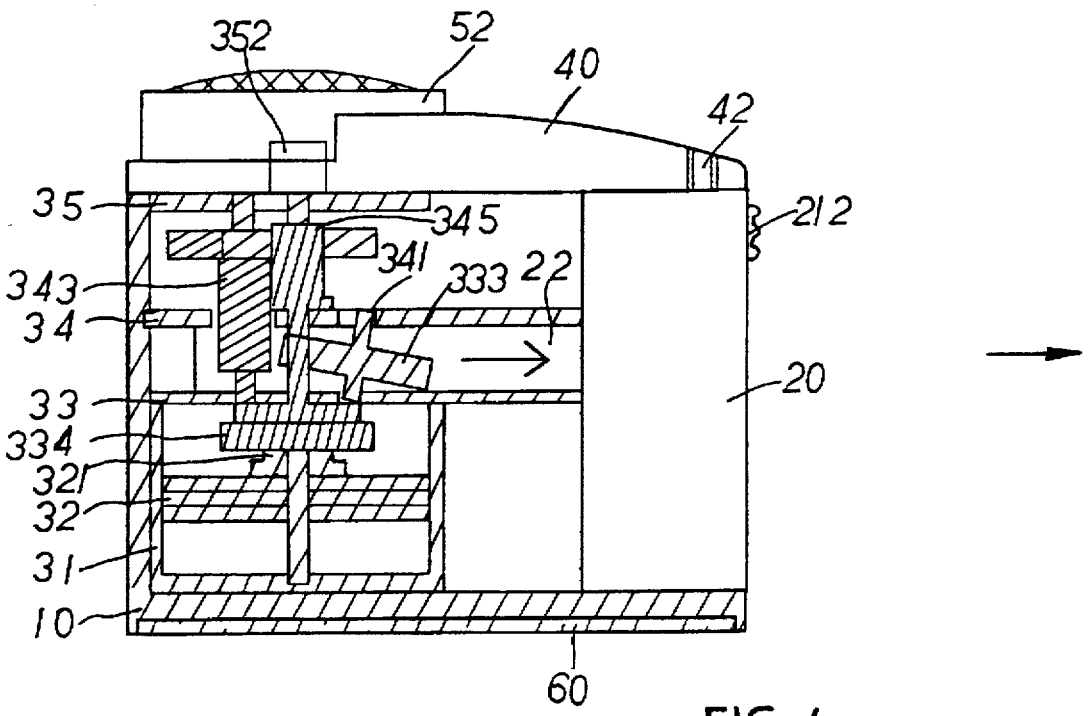

As shown in FIG. 4, when the push button 21 is released, the compressed spring 23 and the push pin 24 in the long hole 221 of the rack 22 shall immediately push the push button 21 outward due to a recovery force of the compressed spring 23. At this point, the second gear 333 meshing with teeth of the rack 22 and having an upper shaft extending through the oblong shaft hole 341 on the second deck 34 shall also be biased from its normal position and disengages from the pinion below the fourth gear 343. This means the release of the push button 21 will not adversely affect the rotating speed of the flywheel 32 while the flywheel 32 keeps rotating under the inertia, bringing the shaving blade seat 52 to keep rotating, too. With repeated pressing and releasing of the push button 21, the gears 333, 334, 343, 344, 345 and the flywheel 32 keep moving in a circulating manner without the need of any electric power, permitting the razor of the present invention to function like a power-operated razor.

Figure 5:
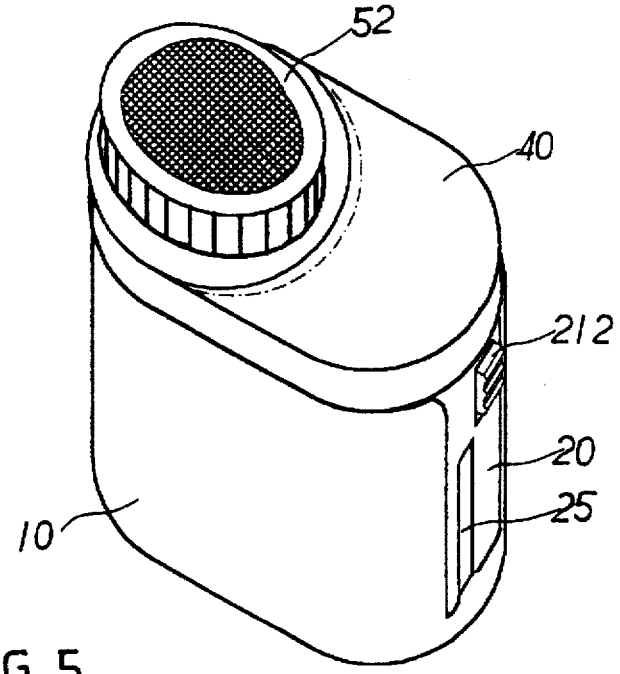
FIG. 5 illustrates the present invention with the push button pushed inward and held in the housing of the present invention.

Please now refer to FIGS. 5 and 1 at the same time. After the razor of the present invention has been used for shaving and is cleaned with the brush 25, the push button 21 can be pushed into the housing 10 and the switch button 212 is pushed upward, so that the cotter 213 is moved upward to extend into the receiving hole 42 on the top cover 40 and be retain thereto, preventing the push button 21 from moving outward under the spring force of the compressed spring 23. The razor with the retracted push button 21 has a compact volume and is suitable for convenient storage or carrying.

With the above arrangements, the mechanically operated razor of the present invention can perfectly function without any electric power supply. The razor also has simple structure which can be easily assembled and the parts thereof are not easily subject to wear off. In brief, the razor of the present invention has longer usable life and compact volume for convenient storage or carrying, and is therefore very practical in use.

Although the present invention has been described with the preferred embodiment thereof, it should be noted that the present invention is not limited to such embodiment and various changes can be made without departing from the spirit of the present invention or the scope of the subjoined claims.

What is claimed is:

1. A mechanically operated razor which does not require any electric power supply while functioning as a power-driven shaver, comprising a housing, a driving means, a transmission means, a top cover, and a shaving blade means;

said housing being provided at a distant end with an opening, at two inner wall surfaces near said opening with locating members, and at another inner end opposite to said opening with a dent;

said driving means being movably set in said opening of said housing and comprising a push button, a rack, a spring, and a push pin; said push button being provided at a rear surface with laterally projected projections, at a front surface with a switch button, and at a top with a movable cotter coupled with said switch button; and said rack being formed in an inner central portion with a long hole to receive said spring and said push pin therein;

said transmission means being mounted in said housing and comprising a base, a flywheel, a first deck, a second deck, and a third deck; said base being provided at a top periphery with lugs to engage with an outer periphery of said first deck; said flywheel having a first gear located at a top center thereof, said first deck including a channel portion into which said rack is movably inserted with teeth of said rack meshing with a second gear located at one side of said channel portion, several internally threaded sleeves being provided on said first deck at two outer sides of said channel portion and a third gear below said first deck to engage with said first gear on said flywheel; said second deck being positioned over said first deck and having a fourth, a fifth and a sixth gears mounted thereon to form a gear set capable of transforming a push force from said driving means into a rotating kinetic energy and transmitting said rotating kinetic energy to said shaving blade means and said flywheel, a lug being formed at a rear end of said second deck to engage with said dent formed on said inner end of said housing; said third deck having internally threaded sleeves provided at a bottom surface corresponding to said threaded sleeves on said first deck, and a cap tightly fitted to a top of an upper shaft of said fifth gear projecting through said third deck;

said top cover being fitted to a top periphery of said housing and having a top shallow recess at a position corresponding to said transmission means, and a receiving hole at a bottom surface for engaging with said cotter of said push button when said cotter is caused to move upward; and said shaving blade means including a shaving blade seat having multiple blades mounted thereon and a sieve-like blade cover, said shaving blade seat being positioned in said top shallow recess of said top cover and said blade cover being screwed to an outer periphery of said shallow recess; and a hole being formed below said shaving blade seat for fitly engaging with said cap of said third deck;

whereby when said push button of said driving means is pushed toward said housing, said teeth of said rack mesh with and rotate said second gear which in turn transmits a rotating kinetic energy via said gear set formed from said fourth, said fifth and said sixth gears to said cap and causes said shaving blade seat engaging with said cap to rotate rapidly, said rotating kinetic energy being transmitted to said flywheel via said third and said first gears at the same time, causing said flywheel to rotate, too; said flywheel keeping rotating due to an inertia and thereby causes said shaving blade seat to rotate for a prolonged time; and whereby when said push button is released and is pushed outward by said spring and said push pin received inside said rack, said second gear being biased when said rack is pulled outward by said outward moving push button without adversely affecting the rotating of said gear set and said flywheel, allowing said flywheel to keep rotating under inertia and to prolong the rotating of said shaving blade seat.

2. A mechanically operated razor as claimed in claim 1, wherein said push button is formed behind said front surface with a flat compartment for a cleaning brush to removably set therein, said cleaning brush having a boss which detachably engages with a dent formed on a wall of said compartment, permitting said cleaning brush to attach to said compartment.

3. A mechanically operated razor as claimed in claim 1, wherein said housing is formed at an outer bottom surface with a recess to removably receive a mirror therein.

* * * * *